US010549351B2

(12) United States Patent
Heguri et al.

(10) Patent No.: US 10,549,351 B2
(45) Date of Patent: Feb. 4, 2020

(54) METHOD FOR PRODUCING NICKEL POWDER

(71) Applicant: SUMITOMO METAL MINING CO., LTD., Tokyo (JP)

(72) Inventors: Shin-ichi Heguri, Niihama (JP); Yoshitomo Ozaki, Niihama (JP); Kazuyuki Takaishi, Niihama (JP); Tomoaki Yoneyama, Niihama (JP); Hideki Ohara, Niihama (JP); Osamu Ikeda, Niihama (JP); Yohei Kudo, Niihama (JP)

(73) Assignee: Sumitomo Metal Mining Co., Ltd. (JP)

( * ) Notice: Subject to any disclaimer, the term of this patent is extended or adjusted under 35 U.S.C. 154(b) by 121 days.

(21) Appl. No.: 15/544,541

(22) PCT Filed: Mar. 26, 2015

(86) PCT No.: PCT/JP2015/059451
§ 371 (c)(1),
(2) Date: Jul. 19, 2017

(87) PCT Pub. No.: WO2016/117138
PCT Pub. Date: Jul. 28, 2016

(65) Prior Publication Data

US 2018/0009037 A1 Jan. 11, 2018

(30) Foreign Application Priority Data

Jan. 22, 2015 (JP) ..... 2015-010719
Jan. 22, 2015 (JP) ..... 2015-010721
Jan. 22, 2015 (JP) ..... 2015-010722

(51) Int. Cl.
*B22F 9/26* (2006.01)

(52) U.S. Cl.
CPC ..... *B22F 9/26* (2013.01); *B22F 2301/15* (2013.01)

(58) Field of Classification Search
CPC ..... B22F 9/18; B22F 9/20; B22F 9/22; B22F 9/24; B22F 9/26; B22F 2201/013; B22F 2301/15
See application file for complete search history.

(56) References Cited

U.S. PATENT DOCUMENTS 2,853,380 A * 9/1958 Evans ..... C22B 15/0063 75/370
3,156,556 A * 11/1964 Evans ..... B22F 9/26 75/370

(Continued)

FOREIGN PATENT DOCUMENTS

CN 101428349 A 5/2009
CN 103803813 A 5/2014

(Continued)

OTHER PUBLICATIONS

Chinese Office Action dated Mar. 13, 2018 for application 201580074006.6.

(Continued)

*Primary Examiner* — Vanessa T. Luk
(74) *Attorney, Agent, or Firm* — Gerald E. Hespos; Michael J. Porco; Matthew T. Hespos

(57) ABSTRACT

A method for producing nickel powder sequentially includes: a mixing step of adding, to a nickel ammine sulfate complex solution, an insoluble solid as seed crystals and a polyacrylate or lignosulfonate as a dispersant to form a mixed slurry; and a reduction and precipitation step of charging a reaction vessel with the mixed slurry and blowing hydrogen gas into the mixed slurry in the reaction vessel to reduce nickel complex ions in the mixed slurry to form nickel precipitate on the surface of the insoluble solid, (Continued)

wherein the amount of the dispersant added in the mixing step is controlled to control the number of the nickel powder obtained by formation of the nickel precipitate in the reduction and precipitation step.

9 Claims, 6 Drawing Sheets

(56) References Cited

U.S. PATENT DOCUMENTS

| | | | | |
|---|---|---|---|---|
| 5,584,908 | A | 12/1996 | Scheie | |
| 2005/0268992 | A1 | 12/2005 | Kagohashi et al. | |
| 2010/0208410 | A1 | 8/2010 | Okada et al. | |
| 2010/0263486 | A1* | 10/2010 | Yang | B22F 9/24 75/374 |

FOREIGN PATENT DOCUMENTS

| | | | |
|---|---|---|---|
| CN | 101808767 | A | 8/2018 |
| JP | 10-509213 | | 9/1998 |
| JP | 2005-505695 | | 2/2005 |
| JP | 2006-152344 | | 6/2006 |
| JP | 4286220 | | 4/2009 |
| JP | 2010-53409 | | 3/2010 |
| JP | 2010-242143 | | 10/2010 |

OTHER PUBLICATIONS

"The Manufacture and properties of Metal powder produced by the gaseous reduction of aqueous solutions", Powder metallurgy, No. 1/2 (1958), 40-52.

International Search Report dated May 19, 2015. WIPO Appl. No. PCT/JP2015/059451.

* cited by examiner

METHOD FOR PRODUCING NICKEL POWDER

BACKGROUND

1. Field of the Invention

The present invention relates to a method for producing fine nickel powder which can be utilized as seed crystals from a solution containing a nickel ammine sulfate complex, and particularly, the present invention can be applied to the treatment for controlling the number of nickel powder generated to requirement.

2. Description of the Related Art

Examples of known methods for producing fine nickel powder include dry methods such as an atomizing method of dispersing molten nickel in a gas or in water to obtain fine powder and a CVD method of volatilizing nickel and reducing it in a vapor phase to thereby obtain nickel powder as shown in Japanese Patent Laid-Open No. 2005-505695.

Further, examples of methods for producing nickel powder by a wet process include a method of forming nickel powder using a reducing agent as shown in Japanese Patent Laid-Open No. 2010-242143 and a spray pyrolysis method in which nickel powder is obtained by pyrolysis reaction by spraying a nickel solution into a reducing atmosphere at high temperatures as shown in Japanese Patent No. 4286220.

However, these methods are not economical because they require expensive reagents and a large amount of energy.

On the other hand, a method of obtaining nickel powder by feeding hydrogen gas into a nickel ammine sulfate complex solution to reduce nickel ions in the complex solution as shown in "The Manufacture and properties of Metal powder produced by the gaseous reduction of aqueous solutions", Powder metallurgy, No. 1/2 (1958), 40-52 is industrially inexpensive and useful. However, nickel powder particles obtained by this method are easily coarsened, and it has been difficult to produce fine powder that can be used as seed crystals.

Thus, when particles are intended to be generated from an aqueous solution and grown, there is used a method of obtaining a powder having a predetermined particle size by allowing a small amount of fine crystals called seed crystals to coexist and feeding a reducing agent thereto to grow the seed crystals.

Although seed crystals used in this method are obtained by grinding products in many cases, time and effort are required and the yield decreases, which leads to an increase in cost. Further, seed crystals having the best particle size and properties are not necessarily obtained by grinding.

Further, in order to stably advance the operation related to the production of nickel powder, it is necessary to always feed a suitable amount of seed crystals, but excessive preparation of seed crystals will lead to a reduction in production efficiency, such as an increase in goods in process and an increase in time and effort of control. Thus, a method for stably obtaining seed crystals in an amount required for real operation has been required.

In such a situation, the present invention provides a method for producing nickel powder, in which fine nickel powder used as seed crystals required for producing nickel powder is produced from a solution containing a nickel ammine sulfate complex depending on the amount required for producing the nickel powder.

SUMMARY

The first aspect of the present invention to solve such a problem is a method for producing nickel powder, sequentially including: a mixing step of adding a polyacrylate to a solution containing a nickel ammine sulfate complex to form a mixed solution; and a reduction and precipitation step of charging a reaction vessel with the mixed solution and blowing hydrogen gas into the mixed solution in the reaction vessel to bring the hydrogen gas into contact with the mixed solution to reduce nickel complex ions in the mixed solution to precipitate nickel to form nickel powder.

The second aspect of the present invention is a method for producing nickel powder, sequentially including: a mixing step of adding, to a solution containing a nickel ammine sulfate complex, an insoluble solid as seed crystals and a polyacrylate or lignosulfonate as a dispersant to form a mixed slurry; and a reduction and precipitation step of charging a reaction vessel with the mixed slurry and blowing hydrogen gas into the mixed slurry in the reaction vessel to reduce nickel complex ions in the mixed slurry to form precipitate of nickel particles on the surface of the insoluble solid.

The third aspect of the present invention is a method for producing nickel powder, sequentially including: a mixing step of adding, to a solution containing a nickel ammine sulfate complex, an insoluble solid as seed crystals and a polyacrylate or lignosulfonate as a dispersant to form a mixed slurry; and a reduction and precipitation step of charging a reaction vessel with the mixed slurry and blowing hydrogen gas into the mixed slurry in the reaction vessel to reduce nickel complex ions in the mixed slurry to form nickel precipitate on the surface of the insoluble solid, wherein the amount of the dispersant added in the mixing step is controlled to control the number of the nickel powder obtained by formation of the nickel precipitate in the reduction and precipitation step.

The fourth aspect of the present invention is a method for producing nickel powder according to the first aspect of the invention, wherein the concentration of the polyacrylate contained in the mixed solution is in the range of 0.2 to 10.0 g/L.

The fifth aspect of the present invention is a method for producing nickel powder according to the third aspect of the invention, wherein, in the case where the dispersant added in the mixing step is a polyacrylate, the amount of the polyacrylate added is more than 1% by weight and 10% by weight or less of the amount of the insoluble solid added to the mixed slurry.

The sixth aspect of the present invention is a method for producing nickel powder according to the fifth aspect of the invention, wherein the amount of the polyacrylate added as a dispersant is 2 to 6% by weight based on the weight of the insoluble solid as seed crystals.

The seventh aspect of the present invention is a method for producing nickel powder according to the fourth to sixth aspect of the invention, wherein the polyacrylate as a dispersant is sodium polyacrylate (PAA).

The eighth aspect of the present invention is a method for producing nickel powder according to the third aspect of the invention, wherein, in the case where the dispersant added in the mixing step is a lignosulfonate, the amount of the lignosulfonate added is 2% by weight or more and 20% by weight or less of the amount of the insoluble solid added to the mixed slurry.

The present invention can provide a method for producing the best fine nickel powder as seed crystals used for economically and efficiently producing nickel powder depending on required amount by a reduction and precipitation method using hydrogen gas from a nickel ammine sulfate complex solution. Thus, an industrially remarkable effect can be achieved.

DETAILED DESCRIPTION

The present invention provides a method for producing nickel powder including adding, to a nickel ammine sulfate complex solution, a dispersant or a dispersant and an insoluble solid as seed crystals to form a mixture and blowing hydrogen gas into the mixture to thereby produce nickel powder, wherein a target amount of fine nickel powder is produced by controlling the amount of the dispersant added.

Hereinafter, the method for producing nickel powder according to the present invention will be described with reference to the production flow chart shown in FIGS. 1 and 2.

[Nickel Ammine Sulfate Complex Solution]

Examples of a suitable nickel ammine sulfate complex solution used in the present invention include, but are not limited to, a nickel ammine sulfate complex solution obtained by dissolving a nickel-containing material such as an industrial intermediate including one or a mixture of two or more selected from nickel and cobalt mixed sulfide, crude nickel sulfate, nickel oxide, nickel hydroxide, nickel carbonate, nickel powder, and the like with sulfuric acid or ammonia according to the components to obtain a nickel leaching solution (solution containing nickel), subjecting the nickel leaching solution to a purification step such as solvent extraction, ion exchange, and neutralization to obtain a solution from which impurity elements in the nickel leaching solution have been removed, and adding ammonia to the resulting solution to form the nickel ammine sulfate complex solution.

[Mixing Step]

In this step, a dispersant is first added to the nickel ammine sulfate complex solution.

Examples of the dispersant used here include, but are not limited to, polyacrylates (refer to FIG. 1) when the dispersant is singly added and used; and polyacrylates or lignosulfonates (refer to FIG. 2) when the dispersant is used in combination with an insoluble solid as seed crystals. Suitable examples include polyacrylates available inexpensively and industrially such as calcium polyacrylate, sodium polyacrylate, and potassium polyacrylate, and lignosulfonates such as calcium lignosulfonate, sodium lignosulfonate, and potassium lignosulfonate.

Figure 1:
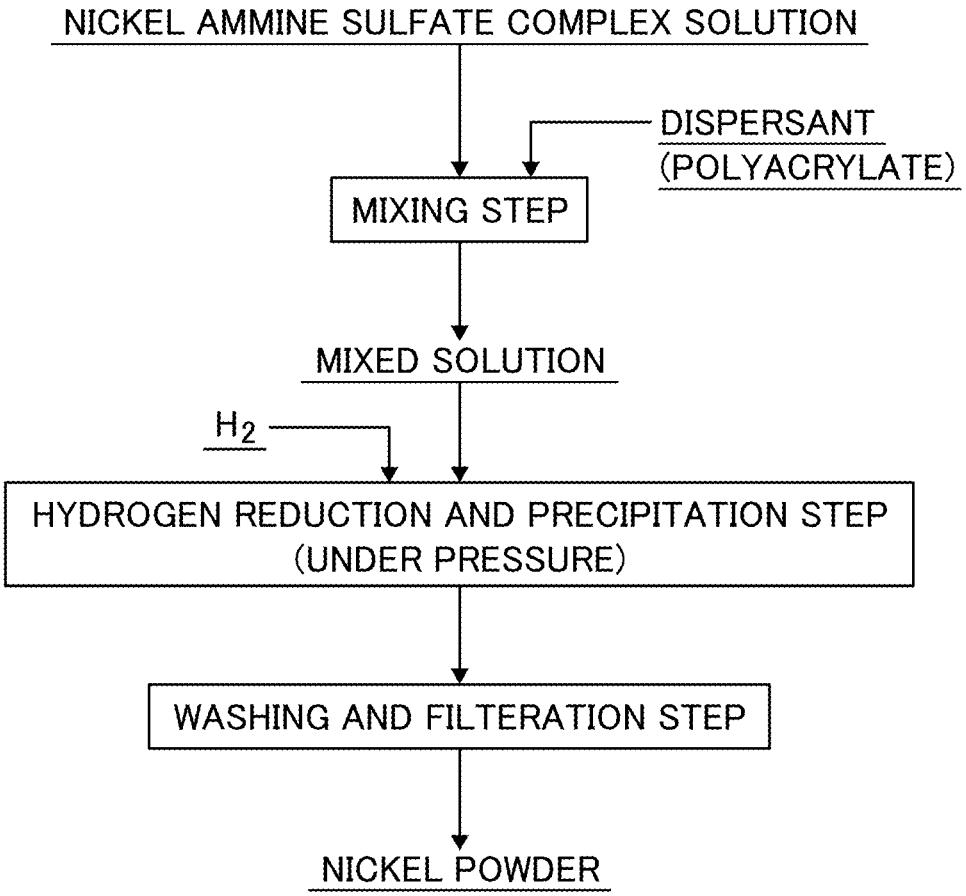
FIG. 1 is a production flow chart in the method for producing nickel powder, in which only a dispersant is added, according to the present invention.
Figure 2:
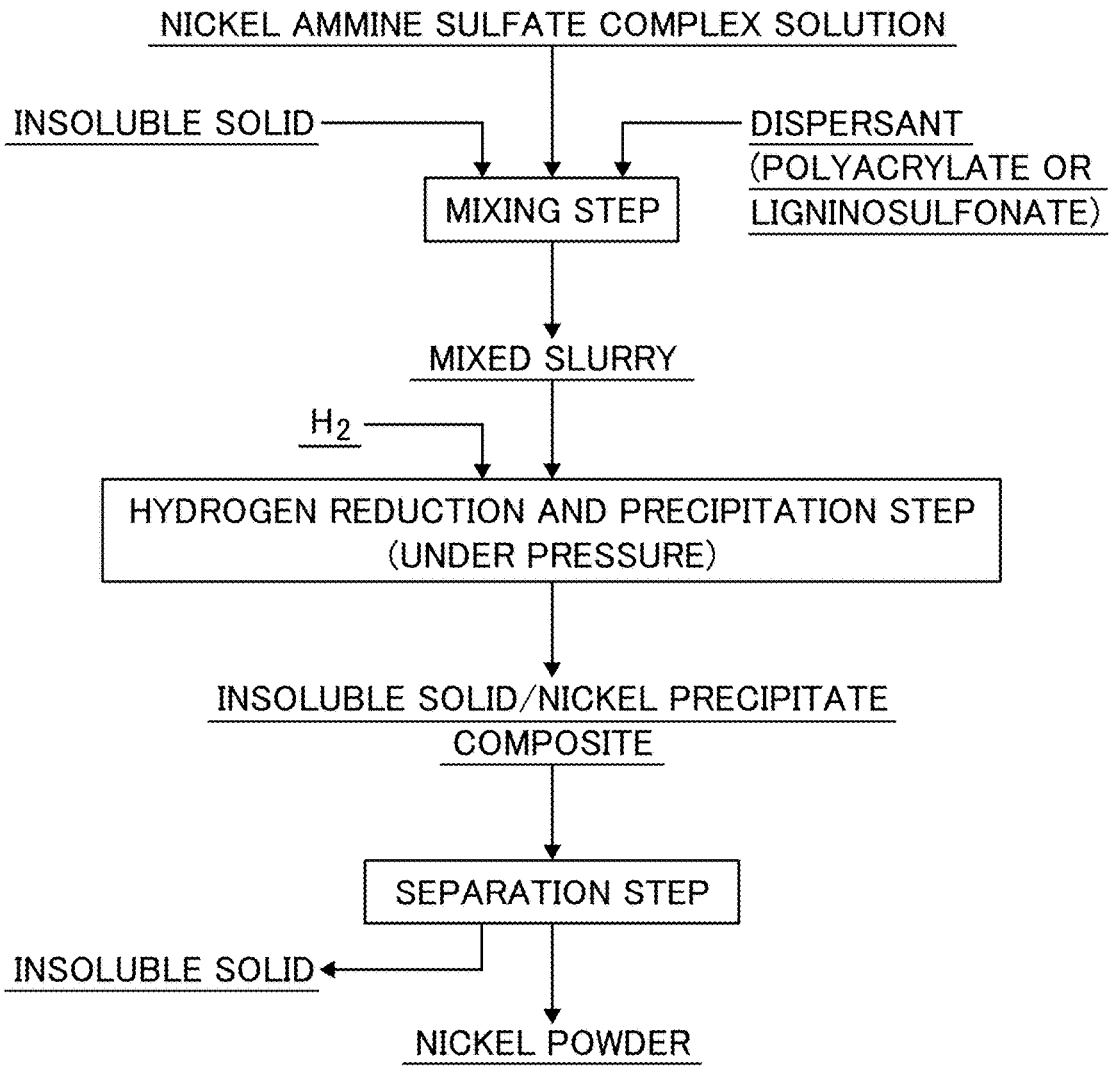
FIG. 2 is a production flow chart in the method for producing nickel powder, in which a dispersant and an insoluble solid are added, according to the present invention.

Further, the concentration of ammonium sulfate in the solution is preferably in the range of 10 to 500 g/L, in both the production methods shown in FIGS. 1 and 2. If the concentration is more than 500 g/L, the solubility will be exceeded, and crystals will be precipitated. Further, since ammonium sulfate is newly formed by reaction, it is difficult to achieve a concentration of less than 10 g/L.

Here, when nickel powder is produced using a polyacrylate as a dispersant without using seed crystals (a production method shown by the production flow in FIG. 1), a mixed solution in which the concentration of ammonium sulfate and the concentration of the dispersant are adjusted is prepared and fed to next reduction and precipitation step. In this case, nickel powder can be satisfactorily produced without seed crystals at a concentration of the dispersant in the mixed solution in the range of 0.2 to 10.0 g/L and a concentration of the ammonium sulfate in the above range.

On the other hand, when an insoluble solid is used as seed crystals and a polyacrylate is used as a dispersant (a production method shown by the production flow of FIG. 2), the amount of the polyacrylate added is more than 1% by weight and 10% by weight or less, preferably 2% by weight or more and 6.0% by weight or less, of the amount of the insoluble solid added to the mixed slurry.

If the amount of the polyacrylate added is 1% by weight or less, nickel powder will not be precipitated, but when the amount of the polyacrylate added is 2% by weight or more, the insoluble solid is sufficiently dispersed, and hence the number of nickel powder generated in proportion to the amount of the polyacrylate added can be preferably controlled. On the other hand, the upper limit of the amount of the polyacrylate is 10% by weight or less, more preferably 6% by weight or less, because the number of nickel powder produced tends to increase even if the upper limit is more than 6% by weight, but because the production of an excessively large number of seed crystals makes them hard to handle and induces agglomeration of dispersant particles, and therefore it is not preferred in consideration of the effect corresponding to the amount of the polyacrylate added.

Further, when a lignosulfonate is used as a dispersant (production method shown by the production flow of FIG. 2), the amount of the lignosulfonate added is 2% by weight or more and 20% by weight or less of the amount of the insoluble solid added to the mixed slurry.

If the amount of the lignosulfonate added is less than 2% by weight, nickel powder cannot be obtained. Therefore, the amount the lignosulfonate added needs to be 2% by weight or more. Particularly, the amount the lignosulfonate added is preferably more than 5% by weight because the number of nickel powder generated in proportion to the amount of the lignosulfonate added can be controlled.

<Addition of Insoluble Solid>

In the production method shown in FIG. 2, an insoluble solid which is insoluble at least in a nickel ammine sulfate complex solution, in which the dispersant concentration has been adjusted as described above, is added to the complex solution and used as a matrix for precipitation.

The insoluble solid added here is not particularly limited as long as it has a low solubility in a nickel ammine sulfate complex solution, an aqueous ammonium sulfate solution, or an alkali solution, and examples thereof that can be used include nickel powder, iron powder, alumina powder, zirconia powder, and silica powder.

The present invention does not employ a conventional commonly-used method of using seed crystals to precipitate a powder and obtaining a product including the seed crystals. In the present invention, after the required precipitation on the surface of the insoluble solid has been completed, the precipitate which has been precipitated and grown is separated from the insoluble solid, and only the powder portion of the separated precipitate is used as a product. According to such a method of the present invention, the influence on the product caused by an impurity contained in the seed crystals themselves can be avoided.

The amount of the insoluble solid added is not particularly limited, but the amount at which mixing by stirring can be achieved when the insoluble solid is added to the nickel ammine sulfate complex solution is selected depending on the type of the solid. As an example, the amount added may be about 50 to 100 g/L.

The shape and the size of the insoluble solid are also not particularly limited. However, since the nickel precipitate on the surface may be separated by mutually colliding or applying vibration as will be described below, a suitable insoluble solid is that having a strength that endures impact and friction and a shape with a smooth surface so that the nickel precipitate can be effectively separated.

Further, in terms of effective separation between the insoluble solid and the nickel precipitate on the surface thereof, for example, an insoluble solid having a diameter of about 0.05 to 3 mm and a shape with no edges such as spherical or elliptical is easily used in real operation.

Note that the insoluble solid is preferably used as an insoluble solid of the present invention after a deposit and the like on the surface of the insoluble solid is removed by giving collision and impact before nickel is precipitated.

Further, the insoluble solid from which the nickel precipitate is separated can also be repeatedly used again after being subjected to pretreatment such as washing as needed.

[Reduction and Precipitation Step]

Then, a reaction vessel resistant to high pressure and high temperature is charged with a mixed slurry formed by adding only a dispersant or a dispersant and an insoluble solid, and hydrogen gas is blown into the mixed slurry in the reaction vessel to reduce nickel complex ions in the mixed slurry. In a mixed slurry to which only a dispersant is added, nickel is precipitated using various fine particles present in the slurry as nuclei to form nickel powder. On the other hand, in a mixed slurry to which both a dispersant and an insoluble solid are added, nickel is precipitated on the insoluble solid added.

The reaction temperature at this time is preferably in the range of 150 to 200° C.

If the reaction temperature is less than 150° C., reduction efficiency will be reduced, and even if it is more than 200° C., the reaction will not be affected, but the loss of thermal energy will increase. Therefore, these temperatures are not suitable.

Further, the pressure during the reaction is preferably 1.0 to 4.0 MPa.

If the pressure is less than 1.0 MPa, reaction efficiency will be reduced, and even if it is higher than 4.0 MPa, the reaction will not be affected, but the loss of hydrogen gas will increase.

By the reduction and precipitation treatment under such conditions, nickel can be extracted and recovered from the nickel ammine sulfate complex solution by the effect of a dispersant; nickel precipitate is formed on the insoluble solid as a fine powdered precipitate by the effect of a dispersant, and nickel can be extracted and recovered from the nickel ammine sulfate complex solution; and the amount of the nickel powder formed by precipitation can be adjusted by adjusting the amount of the dispersant added.

[Separation Step]

This step is a step performed when an insoluble solid is used, in which, since the nickel precipitate formed is in a state where it adheres to the insoluble solid and cannot be utilized in this state, the nickel precipitate formed on the surface is separated and recovered from the insoluble solid.

Examples of specific separation methods of the nickel precipitate include a method of obtaining nickel powder by putting the whole insoluble solid and nickel precipitate in water so that the nickel precipitate is not oxidized by heat generation, rotating the insoluble solid to collide the insoluble solids with each other to separate the nickel precipitate on the surface, and sieving the separated nickel precipitate; a method of obtaining nickel powder by rotating the insoluble solid on a wet sieve to sieve separated nickel precipitate at the same time; and a method of obtaining nickel powder by applying an ultrasonic wave to a liquid to apply vibration to the insoluble solid to separate nickel precipitate and sieving the separated nickel precipitate. In the sieving, a sieve having an opening that is finer than the size of the insoluble solid can be used.

The nickel powder produced as described above can be used, for example, for nickel paste which is an internal constituent of multi-layer ceramic capacitors, and, in addition, can be used for producing high purity nickel metal by repeating the hydrogen reduction described above using the recovered nickel powder as seed crystals to thereby grow particles.

EXAMPLES

The present invention will be described below using Examples.

Example 1

[Mixing Step]

A nickel ammine sulfate complex solution was formed by adding 191 ml of 25% aqueous ammonia to a solution containing 336 g of nickel sulfate hexahydrate, which corresponds to 75 g of nickel, and 330 g of ammonium sulfate. Then, along the production flow shown in FIG. 1, 0.2 g of sodium polyacrylate was first added to the solution to form a mixed solution, the total volume of which was then adjusted to 1000 ml by adding pure water.

[Reduction and Precipitation Step]

Next, an inner cylinder of an autoclave was charged with the prepared mixed solution; the mixed solution was heated to 185° C. with stirring; hydrogen gas was blown into the mixed solution while keeping the temperature; and hydrogen gas was fed from a cylinder so as to maintain the pressure in the inner cylinder of the autoclave at 3.5 MPa. After a lapse of 60 minutes from the start of the feeding of hydrogen gas, the feeding of hydrogen gas was stopped, and the inner cylinder was cooled.

[Filtration Step]

After cooling, the slurry in the inner cylinder was filtered, and 42.7 g of nickel powder was recovered.

Figure 3:
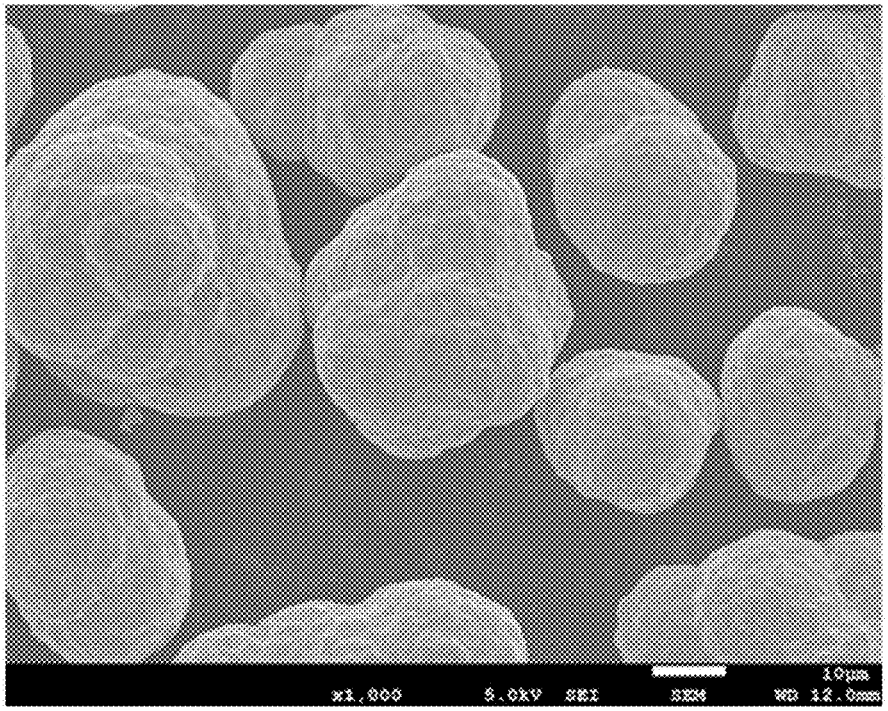
FIG. 3 is a view showing the results of Example 1.

When the recovered nickel powder was observed, it was verified that fine nickel powder was formed as shown in FIG. 3.

Example 2

Nickel powder was produced in the same manner as in the above Example 1 except that 1.0 g of sodium polyacrylate was added.

Figure 4:
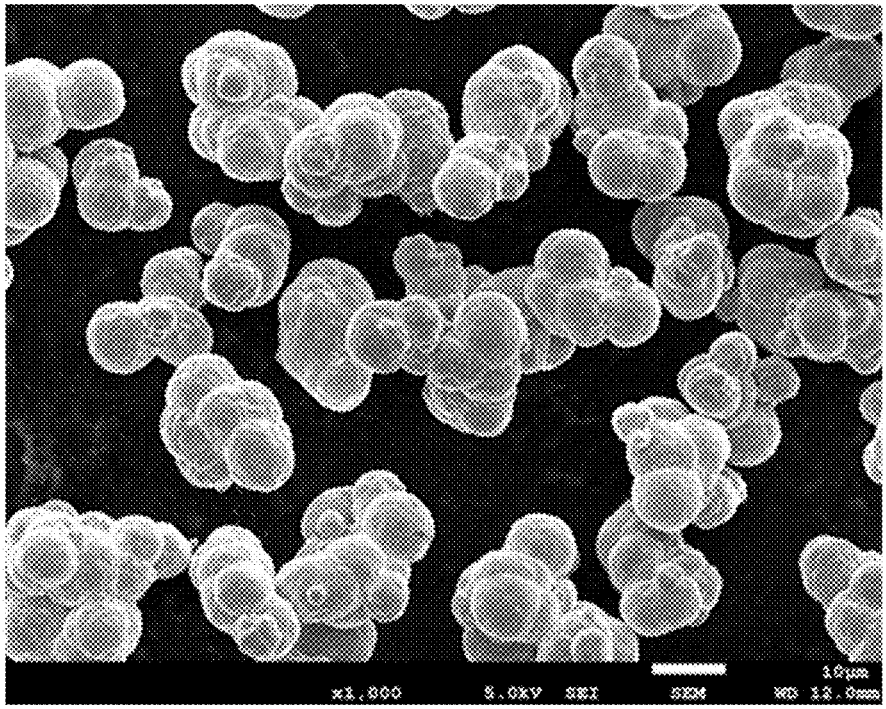
FIG. 4 is a view showing the results of Example 2.

As a result, 59.0 g of fine nickel powder was recovered as shown in FIG. 4.

Example 3

Nickel powder was produced in the same manner as in the above Example 1 except that 5.0 g of sodium polyacrylate was added.

Figure 5:
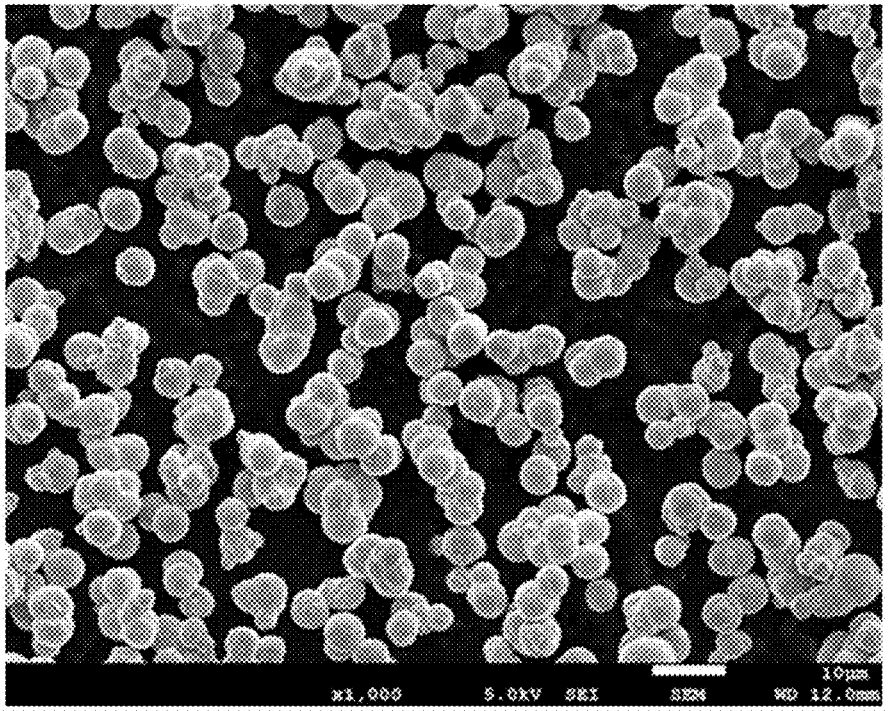
FIG. 5 is a view showing the results of Example 3.

As a result, 68.2 g of fine nickel powder was recovered as shown in FIG. 5.

Example 4

Nickel powder was produced in the same manner as in the above Example 1 except that 10 g of sodium polyacrylate was added.

Figure 6:
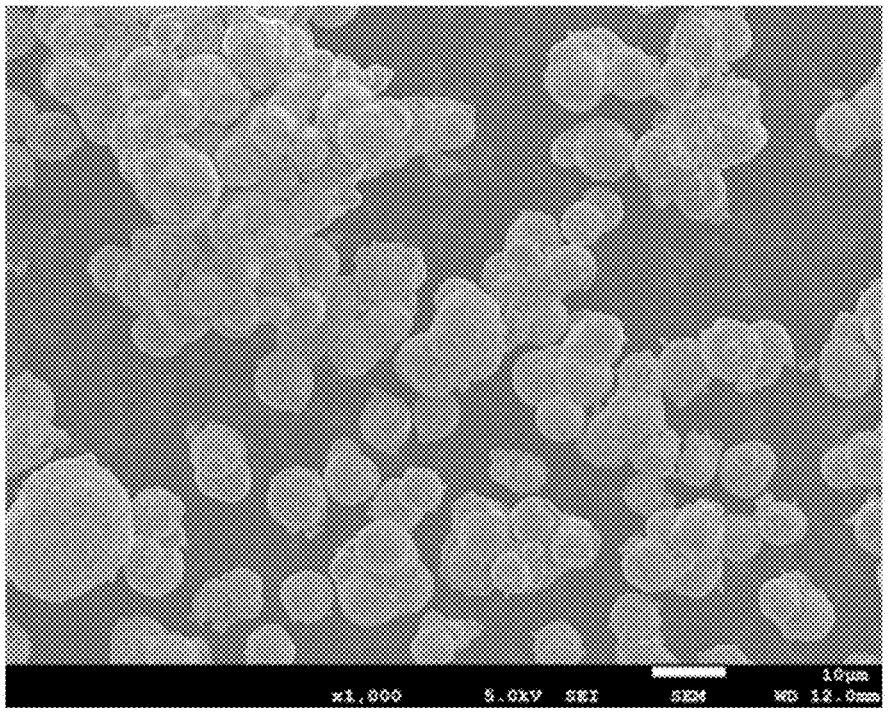
FIG. 6 is a view showing the results of Example 4.

As a result, 57.0 g of fine nickel powder was recovered as shown in FIG. 6.

Example 5

[Mixing Step]

A nickel ammine sulfate complex solution was formed by adding 191 ml of 25% aqueous ammonia to a solution containing 336 g of nickel sulfate hexahydrate, which corresponds to 75 g of nickel, and 330 g of ammonium sulfate. Then, along the production flow shown in FIG. 2, 75 g of nickel powder having an average particle size (D50) of 85 μm was first added to the solution as an insoluble solid used as a matrix for precipitation to be used as seed crystals after adding 1.5 g of sodium polyacrylate having a molecular weight of 4000 as a dispersant, which corresponds to 2% by weight of the weight of the insoluble solid used as seed crystals. The volume of the mixture was then adjusted to 1000 ml by adding pure water to prepare a mixed slurry.

[Reduction and Precipitation Step]

Next, an inner cylinder of an autoclave was charged with the mixed slurry prepared as described above; the mixed slurry was heated to 185° C. with stirring; hydrogen gas was blown from a cylinder into the mixed slurry while keeping the temperature; and hydrogen gas was fed so as to maintain the pressure in the inner cylinder of the autoclave at 3.5 MPa.

A reduced slurry as a sample was removed from a sampling port of the autoclave every 2 minutes after the start of the feeding of hydrogen gas, and the sample was subjected to solid-liquid separation to analyze the nickel concentration in a filtrate. As the reaction proceeds, nickel is precipitated as powder, and the resulting nickel concentration in the filtrate is reduced.

Figure 7:
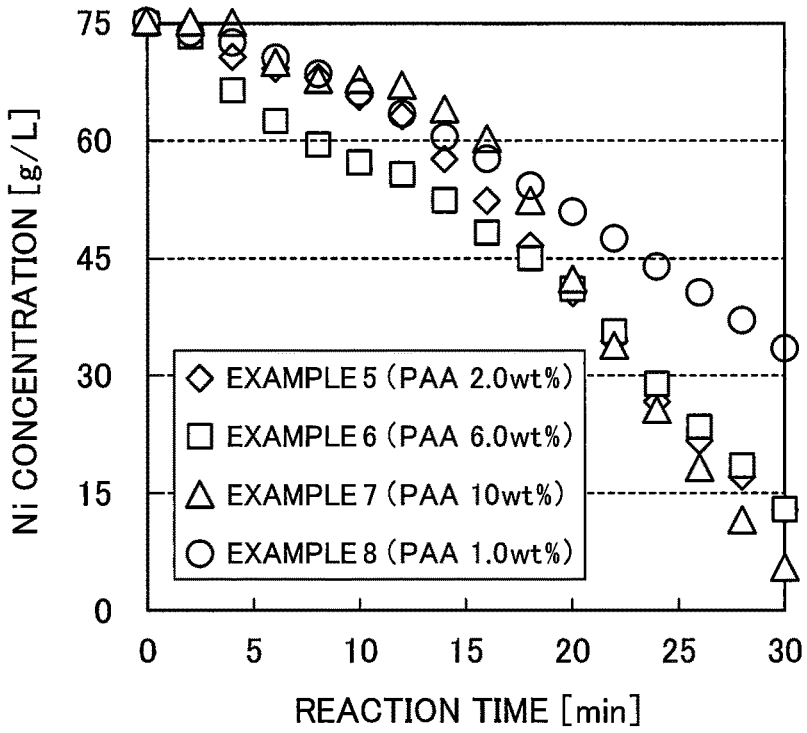
FIG. 7 is a graph showing the change in nickel concentration of the solution after the reaction in each of Examples 5 to 8, together with the amount of sodium polyacrylate used there.

As shown in FIG. 7, 80% or more of nickel was able to be reduced and recovered in 30 minutes based on the calculation from the concentration change of nickel in the filtrate.

After a lapse of 30 minutes from the start of the feeding of hydrogen gas, the feeding of hydrogen gas was stopped, and the inner cylinder was cooled. After cooling, the slurry in the inner cylinder was filtered, and 42.7 g of precipitated nickel powder was recovered.

When the recovered nickel powder was observed, it was verified that nickel powder that is so fine as to be able to be used as seed crystals was formed.

Example 6

Nickel powder was produced and recovered under the same conditions and in the same manner as in the above Example 5 except that sodium polyacrylate was added in an amount of 4.5 g, which corresponds to 6% by weight of the weight of seed crystals.

As shown in FIG. 7, 80% or more of nickel was able to be reduced and recovered in 30 minutes similar to Example 5.

Example 7

Nickel powder was produced and recovered under the same conditions and in the same manner as in the above Example 5 except that sodium polyacrylate was added in an amount of 7.5 g, which corresponds to 10% by weight of the weight of seed crystals.

As shown in FIG. 7, 80% or more of nickel was able to be reduced and recovered in 30 minutes similar to Example 5.

Example 8

Nickel powder was produced and recovered under the same conditions and in the same manner as in the above Example 5 except that sodium polyacrylate was added in an amount of 0.75 g, which corresponds to 1% by weight of the weight of seed crystals.

As shown in FIG. 7, about 50% of nickel was able to be reduced and recovered in 30 minutes based on the calculation from the concentration change.

Comparative Example 1

Nickel powder was produced without adding a dispersant and an insoluble solid, in which other conditions such as solution composition and reduction conditions were the same as in Example 5.

The nickel concentration in the sampled solutions dropped from 75 g/L to about 45 g/L. However, nickel powder was not able to be recovered from the solution after completion of blowing hydrogen gas, but the formation of plate-shaped nickel scaling was able to be observed on a side wall in an inner cylinder and on a stirrer.

Comparative Example 2

Nickel powder was produced in the same manner as in Example 5 except that a dispersant was not added and 75 g of nickel powder was added as an insoluble solid.

Figure 8:
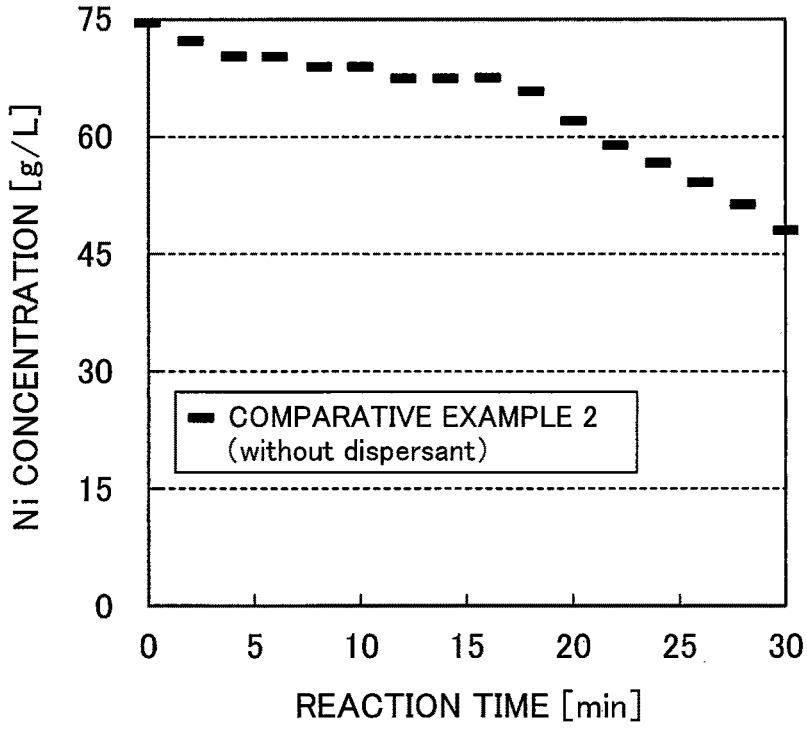
FIG. 8 shows the result of Comparative Example 2 and is a graph showing the change in nickel concentration of a mixed slurry with reaction time during hydrogen reduction.

As shown in FIG. 8, only about 20% of nickel was able to be reduced in 30 minutes based on the calculation from the concentration change.

Example 9

A nickel ammine sulfate complex solution was prepared by adding 191 ml of 25% aqueous ammonia to a solution containing 336 g of nickel sulfate hexahydrate, which corresponds to 75 g of nickel, and 330 g of ammonium sulfate.

Further, along the production flow shown in FIG. 2, solutions containing sodium polyacrylate having a molecular weight of 4000 in a concentration of 40% were added in an amount of 0.38 g, 1.88 g, 3.75 g, 7.5 g, and 11.3 g to each of the prepared nickel ammine sulfate complex solutions to prepare five solutions, in which the total volume was adjusted to 1000 ml.

To each of the prepared solutions, was added 75 g of nickel powder having an average particle size (D50) of 85 μm as an insoluble solid used as a matrix for precipitation to prepare a desired mixed slurry.

The amount of sodium polyacrylate added here corresponds to 0.2% by weight, 1% by weight, 2% by weight, 4% by weight, and 6% by weight in purity, respectively, of the amount of the insoluble solid.

Next, an inner cylinder of an autoclave was charged with the prepared mixed slurry; the mixed slurry was heated to 185° C. with stirring; hydrogen gas was blown into the mixed slurry while keeping the temperature; and hydrogen gas was fed so as to maintain the pressure in the autoclave at 3.5 MPa.

After a lapse of 60 minutes from the start of the feeding of hydrogen gas, the feeding of hydrogen gas was stopped, and the inner cylinder was cooled.

[Separation Step]

After cooling, the slurry in the inner cylinder was filtered to recover a composite of the insoluble solid and nickel precipitate, and a wet sieve having an opening of 75 μm was then used to apply vibration to the composite to separate the insoluble solid as a matrix and the nickel precipitate on the surface to recover nickel powder.

The recovered nickel powder that passed through the sieve was measured for the particle size with a particle size distribution device (trade name: type 9320-X100, manufactured by Microtrac Inc.) to determine particle size distribution.

The recovered nickel powder was assumed to be a real sphere, and the number of the recovered nickel powder was calculated by the following equation (1) using the measured average particle size: D and the density of nickel: $\rho=8.9$ g/cm$^3$.

[Expression 1]

$$\text{Number of nickel powder}=(\text{Mass of recovered nickel powder})/[8.9\times4\pi\times(D/2)^3/3] \quad (1)$$

Figure 9:
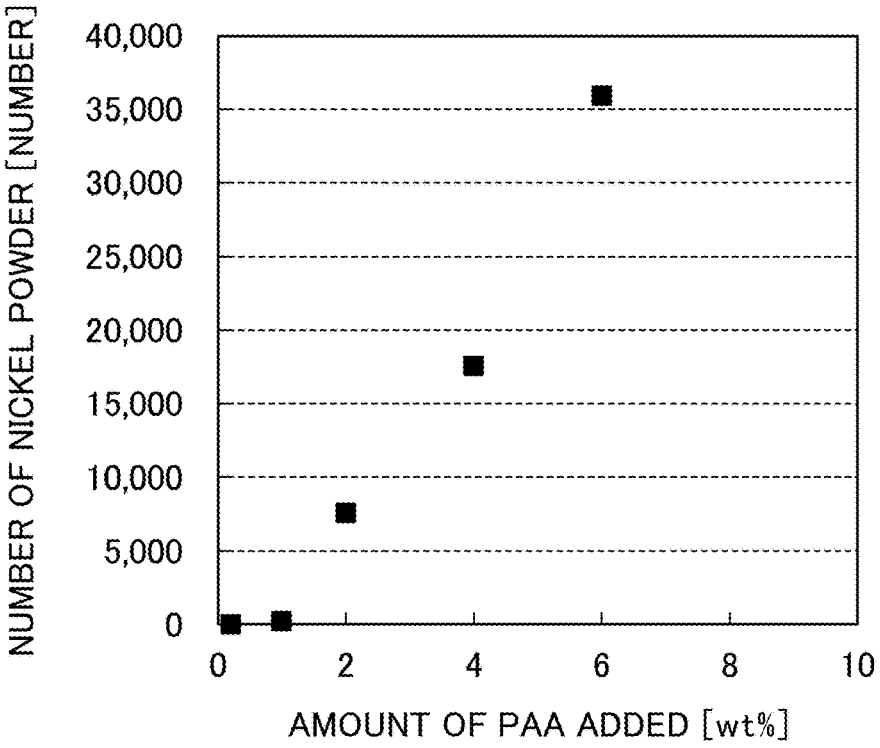
FIG. 9 is a graph showing the relationship between the number of nickel powder and the amount of sodium polyacrylate added according to Example 9.
Figure 10:
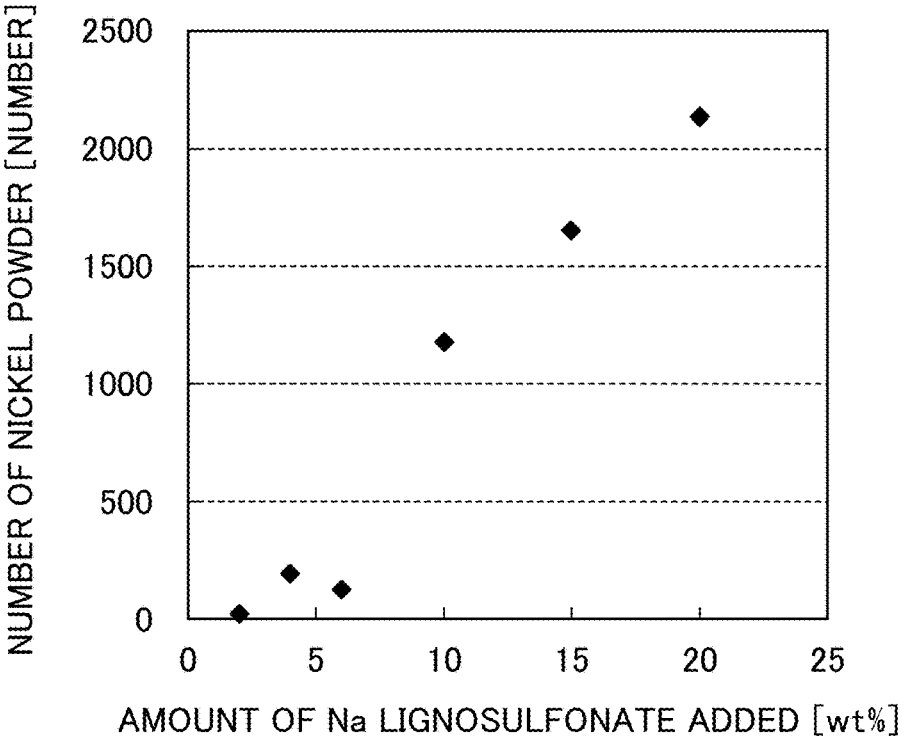
FIG. 10 is a graph showing the relationship between the number of nickel powder and the amount of sodium lignosulfonate added according to Example 10.

The relationship between the number of nickel powder and the amount of sodium polyacrylate added calculated in this way is shown in FIG. 9.

FIG. 9 shows that a correlation is seen between the amount of sodium polyacrylate added and the number of nickel powder, and that the amount of nickel powder generated can be adjusted by the amount of sodium polyacrylate added.

Particularly, FIG. 9 shows that, although nickel powder cannot be obtained when the amount of sodium polyacrylate added is 1.0% by weight or less, the number of nickel powder generated in proportion to the amount of sodium polyacrylate added can be controlled when the amount is more than 1.0% by weight.

Example 10

Nickel powder was produced in the same manner as in Example 9 except that sodium lignosulfonate was used as a dispersant in an amount of 1.5 g, 3.0 g, 4.5 g, 7.5 g, 11.3 g, and 15.0 g.

The amount of the lignosulfonate added corresponds to 2% by weight, 4% by weight, 6% by weight, 10% by weight, 15% by weight, and 20% by weight, respectively, of the amount of the insoluble solid.

The number of nickel powder obtained was calculated by the calculation method using the above equation (1) in the same manner as in Example 9.

The invention claimed is:

1. A method for producing nickel powder, sequentially comprising:

a mixing step of adding, to a solution containing a nickel ammine sulfate complex, an insoluble solid that has a diameter of 0.05 to 3 mm and a shape with no edges as seed crystals, and a predetermined amount of a polyacrylate or lignosulfonate as a dispersant to form a mixed slurry;

a reduction and precipitation step of charging a reaction vessel with the mixed slurry and blowing hydrogen gas into the mixed slurry that is formed in the mixing step in the reaction vessel to reduce nickel complex ions in the mixed slurry to form precipitate of nickel particles on a surface of the insoluble solid; and a separation step of separating the precipitate of nickel particles from the surface of the insoluble solid to form a separated nickel precipitate and sieving the separated nickel precipitate to obtain nickel powder, thereby producing nickel powder with the number of the nickel powder controlled.

2. The method for producing nickel powder according to claim 1, wherein the shape of the insoluble solid is spherical.

3. The method for producing nickel powder according to claim 1, wherein the shape of the insoluble solid is elliptical.

4. A method for producing nickel powder, sequentially comprising:

a mixing step of adding, to a solution containing a nickel ammine sulfate complex, an insoluble solid that has a diameter of 0.05 to 3 mm and a shape with no edges as seed crystals, and a polyacrylate or lignosulfonate as a dispersant to form a mixed slurry;

a reduction and precipitation step of charging a reaction vessel with the mixed slurry and blowing hydrogen gas into the mixed slurry that is formed in the mixing step, in the reaction vessel to reduce nickel complex ions in the mixed slurry to form nickel precipitate on a surface of the insoluble solid; and a separation step of separating the nickel precipitate from the surface of the insoluble solid to form a separated nickel precipitate and sieving the separated nickel precipitate to obtain nickel powder, wherein an amount of the dispersant added in the mixing step is controlled so that when the dispersant is the polyacrylate, an amount of the polyacrylate added is in a range of 1% by weight to 10% by weight of an amount of the insoluble solid added to the mixed slurry or when the dispersant is the lignosulfonate, an amount of the lignosulfonate added is in a range of 2% by weight to 20% by weight of the amount of the insoluble solid added to the mixed slurry, thereby to control the number of the nickel powder obtained by formation of the nickel precipitate in the reduction and precipitation step.

5. The method for producing nickel powder according to claim 4, wherein an amount of the polyacrylate added as a dispersant is 2 to 6% by weight based on the weight of the insoluble solid as seed crystals.

6. The method for producing nickel powder according to claim 5, wherein the polyacrylate as a dispersant is sodium polyacrylate (PAA).

7. The method for producing nickel powder according to claim 4, wherein the polyacrylate as a dispersant is sodium polyacrylate (PAA).

8. The method for producing nickel powder according to claim 4, wherein the shape of the insoluble solid is spherical.

9. The method for producing nickel powder according to claim 4, wherein the shape of the insoluble solid is elliptical.

* * * * *